United States Patent [19]

Szabo

[11] 4,344,619

[45] Aug. 17, 1982

[54] PIVOTED WEIGHT LIFTING APPARATUS

[76] Inventor: William Szabo, 10126 Langmoir Ave., Sunland, Calif. 91040

[21] Appl. No.: 120,154

[22] Filed: Feb. 11, 1980

Related U.S. Application Data

[63] Continuation-in-part of Ser. No. 79,095, Sep. 26, 1979, Pat. No. 4,323,236.

[51] Int. Cl.[3] ..... A63B 21/06

[52] U.S. Cl. ..... 272/117; 272/DIG. 4; 248/161

[58] Field of Search ..... 272/123, 122, 117, 143, 272/DIG. 4, 67, 134, 118

[56] References Cited

U.S. PATENT DOCUMENTS

| | | | |
|---|---|---|---|
| Re. 28,066 | 7/1974 | Marcyan | 272/118 |
| 2,932,509 | 4/1960 | Zinkin | 272/117 |
| 3,010,720 | 11/1961 | Allard | 272/117 |

FOREIGN PATENT DOCUMENTS

| | | | |
|---|---|---|---|
| 1016724 | 9/1952 | France | 272/117 |

*Primary Examiner*—Richard C. Pinkham
*Assistant Examiner*—William R. Browne
*Attorney, Agent, or Firm*—Robert J. Schaap

[57] ABSTRACT

A body exercising apparatus, in the form of a weight lifting apparatus, which includes an elongate lever arm having first and second opposite ends. The first end of the lever arm is capable of being pivotally mounted to a supporting structure, and preferably a relatively vertically disposed wall. For this purpose, a mounting element is provided on the first end of the lever arm for pivotally mounting this lever arm to such relatively permanent structure and preferably such vertically disposed wall. A weight retaining rod, is operatively mounted on the lever arm and is capable of receiving conventional bar-bell type weights in selected amounts. A leg member is secured to the lever arm and extends downwardly therefrom so as to be engageable with a floor or similar horizontal surface to thereby control the lower most limit of movement of the lever arm. A handle member is located at the second end of the lever arm for engagement by the hands of a user of the apparatus so that this user can attempt to lift the lever arm about the pivotal connection with respect to the supporting structure against one or more weights placed on the weight retaining rod. In a more preferred aspect, the handle member is adjustably positionable with respect to the lever arm so as to accommodate the overall height of the user.

15 Claims, 7 Drawing Figures

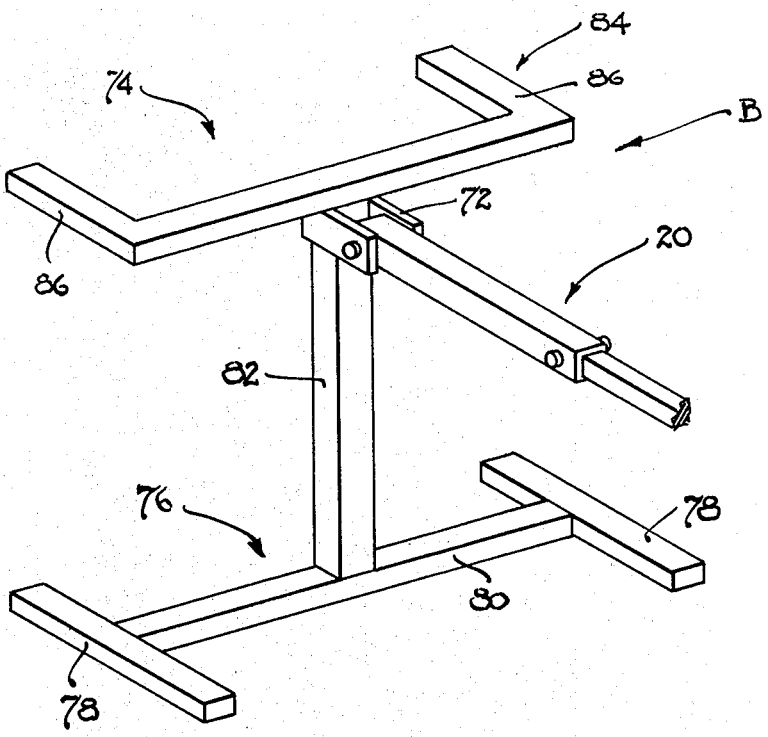
FIG. 5
FIG. 6
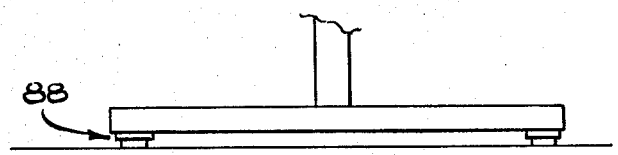
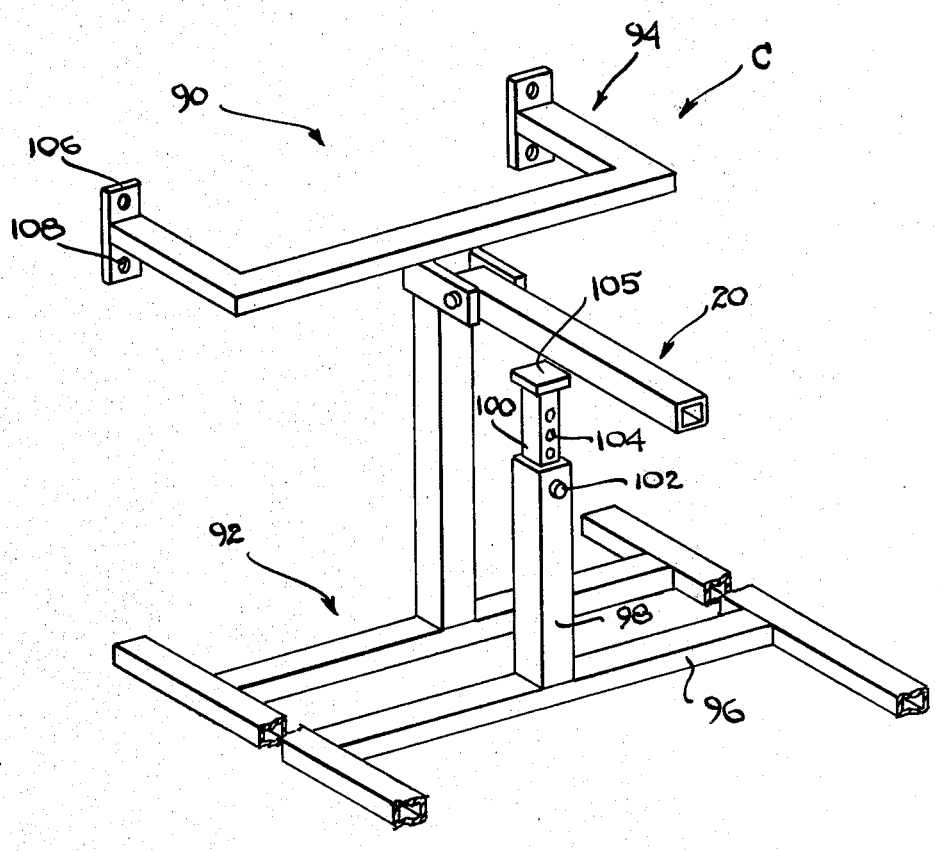
FIG. 7

PIVOTED WEIGHT LIFTING APPARATUS

RELATED APPLICATION

This application is a continuation-in-part of my copending application Ser. No. 079,095 filed Sept. 26, 1979 now U.S. Pat. No. 4,323,236, entitled "Body Exercising Apparatus".

BACKGROUND OF THE INVENTION

1. Field of the Invention

This invention relates in general to certain new and useful improvements in body exercising apparatus, and more particularly, to body exercising apparatus uniquely adaptable for relatively inexpensive employment and in which a user attempts to lift one or more weights selectively located on a lever arm of the apparatus by lifting one end of the lever arm and where the other end thereof is pivotally mounted.

2. Brief Description of the Prior Art

In recent years, there has been an increased awareness and interest in body exercising for purposes of health improvement and control. As a result thereof, there has been a large number of body exercising apparatus which have been introduced into the marketplace. One of the most common types of body exercising apparatus is that in which the user attempts to exert an upwardly directed force, e.g., a lifting force against a weight, as for example, one or more weights placed on a cable. For example, the user of such exercising apparatus is required to exert an amount of force sufficient to overcome a vertical downward force vector imposed by a selected amount of weight placed on or introduced with respect to such apparatus. This weight exercising apparatus may adopt many forms in which the user may assume various positions of use as for example, a prone position, a generally upright position, or the like.

Heretofore, there has not been any commercially available body exercising apparatus which is generally available in a construction which is not mechanically complex and hence a construction which is available at a relatively low unit cost. Typically, each of the commercially available body exercising appatus which involve the lifting of one or more selectively imposed weights are designed for commercial use as for example, in public gymnasiums and so-called "health" establishments.

While the user of "bar-bells" and the so-called "individually hand held dumb-bells" which utilize an elongate bar and one or more generally circular weights mountable thereon have been well known, they are expensive and limited in their effectiveness. There is not commercially available exercising apparatus which may be used, other than by a commercial establishment, and in a relatively low unit cost, by the average individual and which involves a selective placement of weights normally used on such conventional bar-bells and dumb-bells.

OBJECTS OF THE INVENTION

It is, therefore, a primary object of the present invention to provide a body exercising apparatus which simulates that of an exercising apparatus normally found in commercial body exercising institutes but which is provided in a construction and operated in a manner so that it is available at a relatively low cost and is capable of being afforded and used by private individuals, such as home users.

It is another object of the present invention to provide a body exercising apparatus of the type stated which includes a single lever arm capable of being mounted to a relatively permanent generally vertically disposed wall and which is designed to carry the weights selectively introduced by user thereof.

It is yet another object of the present invention to provide a body exercising apparatus of the type stated which comprises a lever arm capable of being mounted to a base frame which is capable of being disposed on a floor or other supporting surface and where the lever arm is designed to carry weights selectively introduced by a user thereof.

It is a further object of the present invention to provide a body exercising apparatus of the type stated which affords all of the flexibility of abody exercising apparatus normally found at commercial body exercising institutes but which is relatively available at a low cost and which is highly reliable in its operation.

It is an additional object of the present invention to provide a body exercising apparatus of the type stated which includes a lever arm which can be permanently mounted to a permanently existing generally vertical wall and which also includes a leg member for limiting the downward movement of the pivotably mounted lever arm and where such arm is designed to carry weights against which an exercisable action is to be exerted.

It is also an object of the present invention to provide a body exercising apparatus of the type stated which includes an adjustably positionable handle mechanism for engagement by a user thereof.

With the above and other objects in view, my invention resides in the novel features of form, construction, arrangement and combination of parts presently described and pointed out in the claims.

BRIEF SUMMARY OF THE DISCLOSURE

A body exercising apparatus comprised of a lever arm which is generally elongate and having first and second opposite ends. A mounting means is provided on the first end of the lever arm for pivotally mounting the lever arm to a generally stationary structure. In one preferred embodiment of the present invention, the lever arm is pivotally mounted to a relatively permanent generally vertically positioned wall.

In an alternative embodiment of the present invention, the lever arm may be physically and pivotally mounted to a structure which is mounted on or otherwise resting upon a floor or similar horizontal surface, as opposed to a generally vertically disposed wall. In this embodiment of the invention, as well as the embodiment of the invention which utilizes a wall mountable exercising apparatus, the invention comprises an adjustable positioning means which is located at the second end of the lever arm, that is the end distal from the pivotal end. Further, a handle is secured to the adjustable positioning means so that the height of the handle is adjustably positionable relative to the lever arm.

The adjustable positioning means in the preferred form of the invention adopts the shape of a tubular member, and particularly a rectangularly shaped tubular member which is secured to the second end of the lever arm. Further, a pole is located within this tubular member and the handle means is secured to the pole. In this way, the tubular member and the pole may have a plurality of vertically spaced apart holes which are alignable in certain positions so that a pin element may be inserted into the aligned holes in the pole and tubular member. In this way, the pole may be locked to the tubular member in any of a plurality of selected positions with respect to the tubular member.

In another preferred aspect of the present invention, the mounting means for pivotally mounting the lever arm to the wall may comprise a bracket having at least one flat plate which engages the flat wall. This bracket means also includes at least one outwardly struck element and preferably a plurality of outwardly struck elements such as a clevised member for pivotally retaining the first end of the lever arm. In another preferred aspect of the invention, the overall length of the lever arm may be adjustable. Thus, the lever arm may be comprised of a first lever arm section which is telescopically located within a second lever arm section. In this way, the lever arm sections may be extended or retracted relative to one another to thereby adjust the overall length of the lever arm.

The term generally vertically disposed wall means a wall or other generally vertically disposed surface to which the lever arm may have one end pivotally mounted. Further the wall or other surface need not be truly vertical but it could be inclined somewhat with respect to a true vertical.

One of the advantages of the apparatus of the present invention, is that it is capable of being constructed at a relatively low cost. For example, one embodiment of the apparatus is designed for wall mounting so as to avoid the necessity of a relatively expensive framework to pivotally retain the lever arm. In addition, the apparatus, is constructed so that it can be made from a relatively few number of pieces, thereby also leading to easy assembly.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principles of the invention, but it is to be understood that such detailed descriptions are not to be taken in a limiting sense.

BRIEF DESCRIPTION OF THE DRAWINGS

Figure 1:
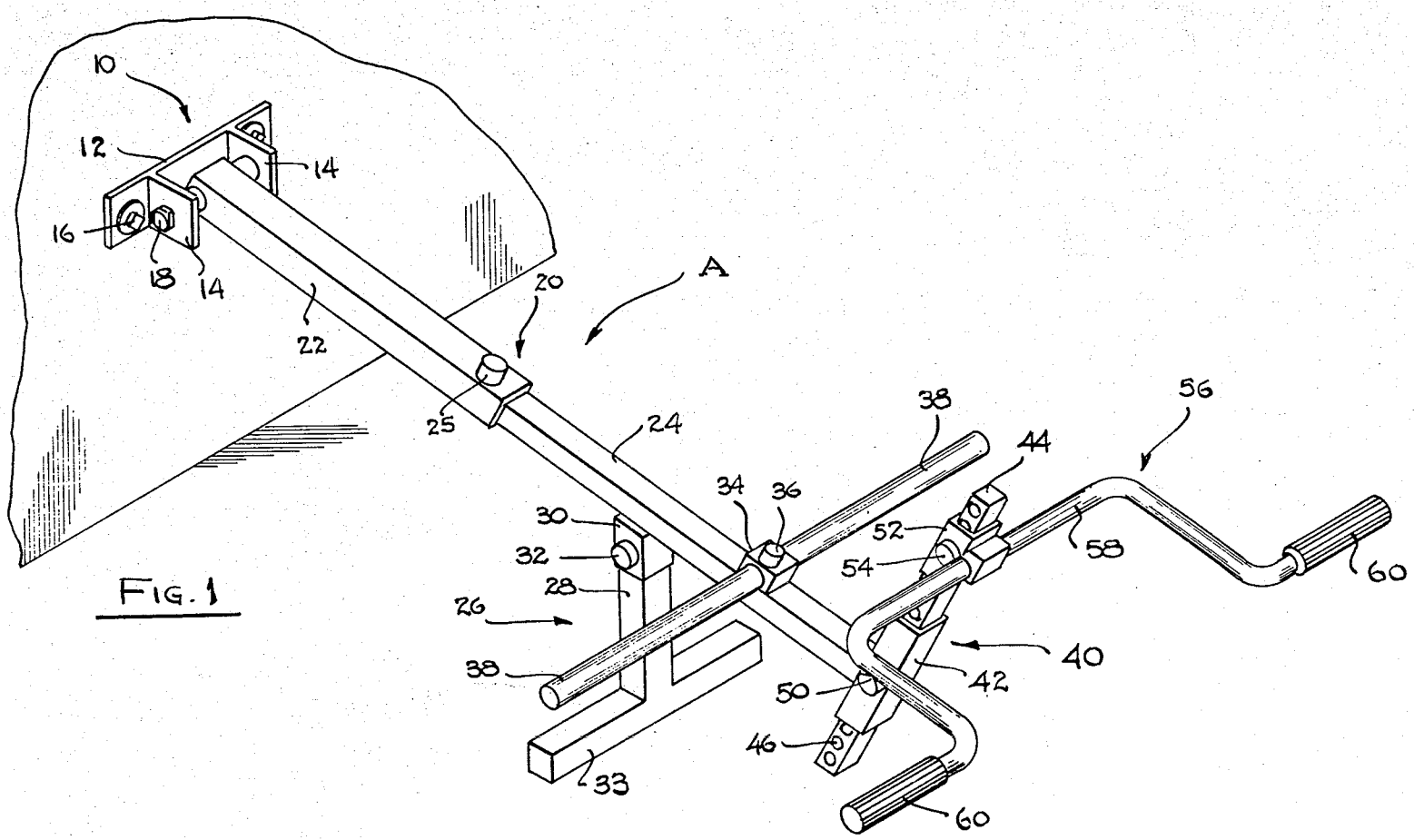
Figure 2:
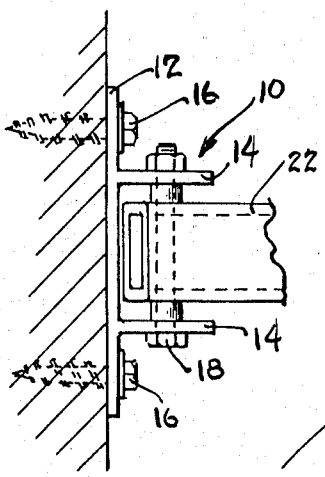
Figure 3:
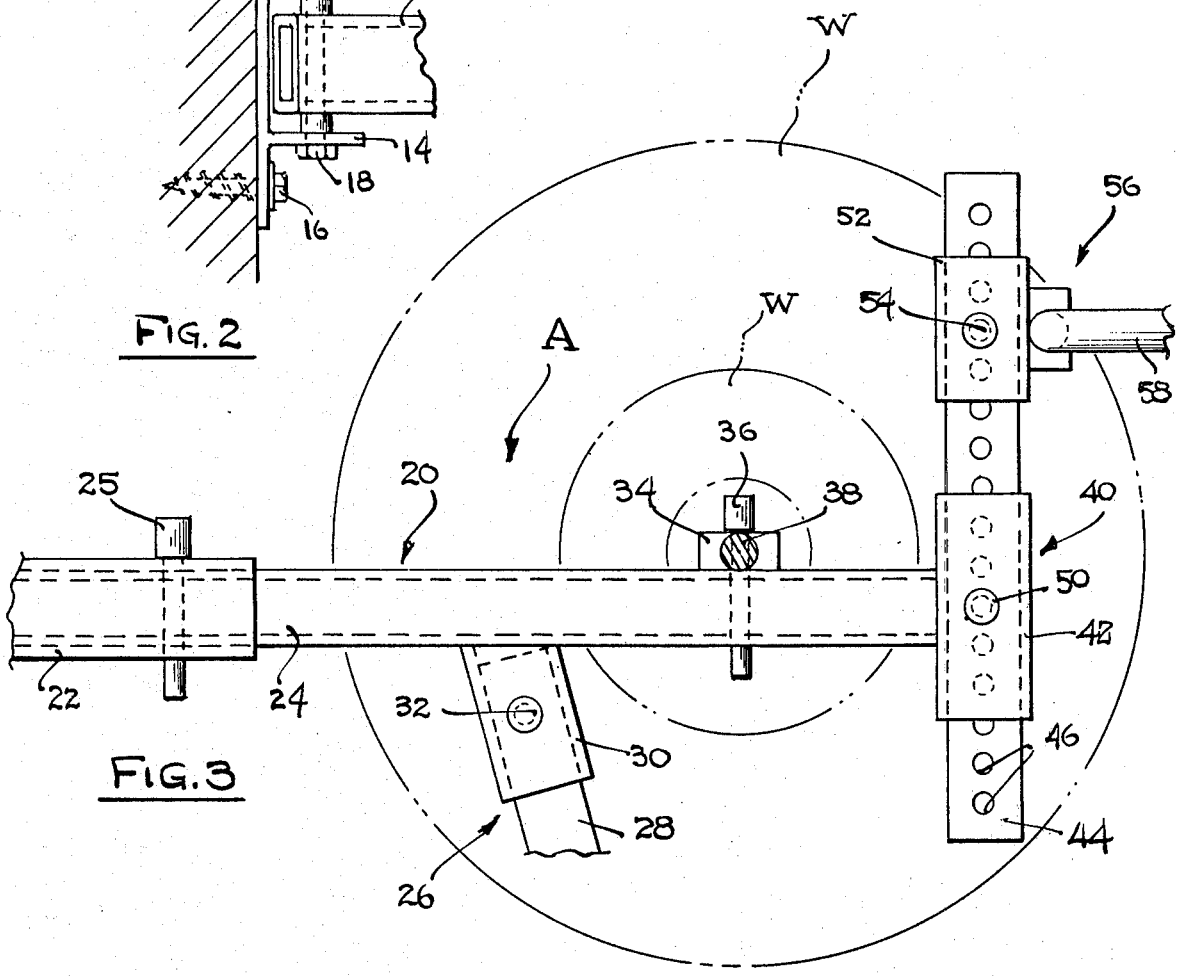
Figure 4:
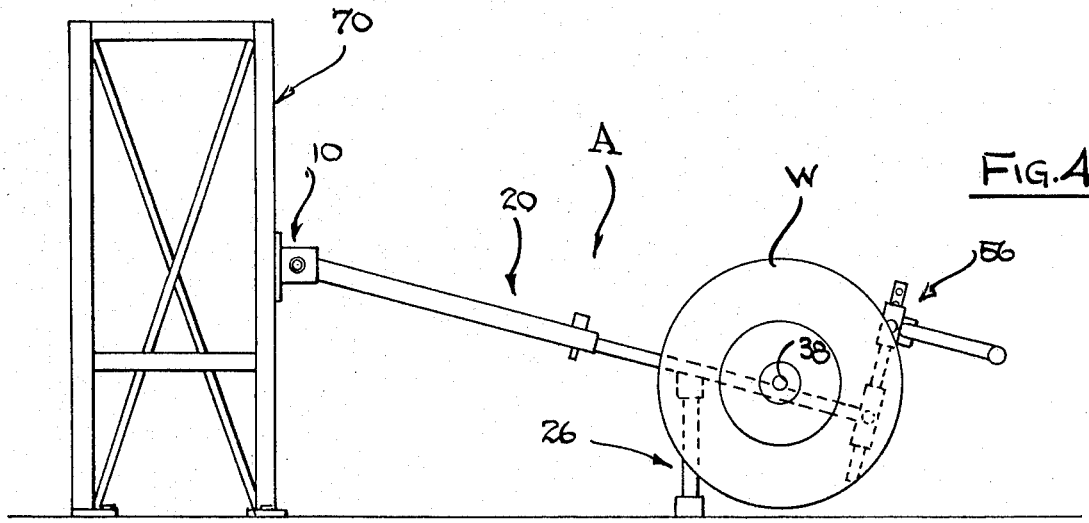

Having thus described the invention in general terms, reference will now be made to the accompanying drawings in which:

FIG. 1 is a perspective view of a weightlifting body exercising apparatus constructed in accordance with and embodying the present invention;

FIG. 2 is a horizontal fragmentary sectional view showing a portion of the mounting means for mounting the apparatus of the present invention to a vertically disposed wall;

FIG. 3 is a vertical sectional view of a portion of the apparatus of FIG. 1 and showing the depending leg mechanism for limiting the lowermost movement of the lever arm and also a means for adjustably positioning a handle mechanism on the lever arm;

FIG. 4 is a fragmentary side elevational view showing an alternate embodiment of the invention in which the lever arm forming part of the exercising apparatus of the present invention is mounted to another structure, as opposed to a vertically disposed wall;

FIG. 5 is a perspective view, of a portion of a modified form of weight lifting body exercising apparatus constructed in accordance with and embodying the present invention;

FIG. 6 is a fragmentary side elevational view showing engagement pads on the lower portion of the frame forming part of the apparatus of FIG. 5; and FIG. 7 is a perspective view, broken away, of another modified form of weight lifting body exercising apparatus constructed in accordance with and embodying the present invention.

DETAILED DESCRIPTION OF PREFERRED EMBODIMENTS

Referring now in more detail and by reference characters to the drawings which illustrate certain practical embodiments of the present invention, A designates a body exercising apparatus which relies upon a construction utilizing conventional bar-bell weights.

The apparatus A is more fully illustrated in FIGS. 1–4 of the drawings. In one of the embodiments of the exercising apparatus A which adopts the configuration of a wall-mounted unit, the apparatus comprises a mounting means, in the form of a bracket 10, which is comprised of a relatively flat plate 12 having at least one and preferably a pair of outwardly struck flanges 14 so as to form a clevised member. Moreover, this mounting means such as the bracket 10 is secured to the wall or other vertically disposed surface by means of one or more bolts or similar mechanical fastening members 16, in the manner as illustrated. Finally, this mounting means is also comprised of a bolt or similar pivot mechanism such as a bolt 18 which receives a first end of a lever arm 20, in the manner as illustrated in FIG. 1 of the drawings.

In one aspect of the present invention, the lever arm 20 is described and illustrated as being mounted on a generally vertically positioned wall. In this case, it should be understood that the bracket 10 should be mounted on at least a structural member which is vertically positioned. Moreover, this wall or other structural member need not be perfectly vertically positioned such that it can be disposed from a true vertical position by a reasonable angle, e.g., 15–30 degrees or so. Nevertheless, it is fairly important with respect to the present invention, in order to maintain simplicity of operation and construction that the pivot arm is pivotally connected to a wall which is considered to be a generally vertical disposed wall which is no greater than about 30 degrees from the true perpendicular to a normal horizontal plane.

Also important in connection with the present invention is the fact that the lever arm 30 is the only component, other than the mounting means, which is physically connected to any stationary structure, as for example, a generally vertically disposed wall. Thus, unlike other prior art apparatus, only the lever arm with the mounting means on the end thereof is physically connected and moreover, is physically pivotally connected to a generally vertically disposed wall or other vertically disposed member. Thus, and also in this concept of the invention, the term "wall" could also adopt a side face of a vertically disposed beam, or the like, as aforesaid.

Also in accordance with the present invention, the generally vertically disposed wall is often referred to as a relatively permanently disposed vertical wall. In this same concept, the term relatively permanent is used in the sense that the wall to which the lever arm is affixed is not periodically moved. Moreover, the term "relatively permanent" with respect to the wall, is used in the sense that this wall typically remains for a substantial period of time, that is a wall which does not serve as a mere partition and which is removed and replaced by another partition on a periodic basis. Further, it should be understood that the term relatively permanent vertically disposed wall is used in the sense that it includes a wall having at least some means for physically retaining a mounting means.

The lever arm of the present invention is adjustably positionable in the sense that its overall length can be adjusted to accomodate a particular environment or a particular application. Consequently, in a preferred embodiment of invention, the lever arm 20 is comprised of a first lever arm section 22, such as an outer tubular lever arm section. The lever arm 20 is also provided with a second lever arm section 24 such as a telescopically disposed lever arm section which is capable of being telescopically disposed within the first lever arm section 22. Thus, by reference to at least FIGS. 1 and 3, it can be observed that the second lever arm section 24 can be telescopically extended or retracted within the first lever arm section 22. Moreover, the second lever arm section may be affixed in a desired position with respect to the first lever arm section 22 in order to achieve a desired length of the overall lever arm 20 and this position may be retained and secured by means of a removable locking pin 25, also as illustrated in FIG. 1 of the drawings. Thus, and for this purpose, the tube 22 as well as the lever arm section 24 would each be provided with a plurality of alignable apertures (not shown). In this way, any reasonable overall telescopic length of the lever arm 20 could be achieved.

Also mounted on the lever arm 20, and particularly the lever arm section 24 is a leg mechanism 26. Here again, the leg mechanism 26 is comprised of a generally vertically disposed or downwardly extending leg 28 which is capable of fitting within the somewhat tubular and preferably rectangularly shaped collar 30 formed on the underside of the second lever arm section 24. Moreover, the leg 28 is retained within the collar 30 in a selected position by means of a bolt or similar removable fastening member 32. It should be understood that the leg 28 could be provided with a plurality of apertures in order to receive the bolt 32. In this way, the leg 28 could be adjustably positioned within the collar 30. Moreover, the leg 28 is provided with a transversely extending cross bar 33 which is adapted to engage the floor or other supporting surface. In this case, it should be understood that the term "floor" represents any generally horizontally disposed surface upon which the leg member 26 may be disposed and supported against lowermost movement of the lever arm 20.

Also welded or otherwise secured to the lever arm 20 and particularly the lever arm section 24 thereof is a transversely extending block 34. Moreover, retained by the block 34, through the action of a pin 36, is a transversely extending somewhat circularly shaped rod 38 which forms part of a weight retaining means on the lever arm in order to removably retain bar-bell type weights. In accordance with this embodiment of the invention, bar-bell type weights W which are typically circularly shaped steel plates having a central aperture therein can be disposed at opposite ends of the rod 38. A plurality of different sized bar-bell type weights are schematically illustrated in phantom lines in FIG. 3. In this way, a plurality of such bar-bell weights can be located on the bar 38 in order to provide the effective weight for the user to lift against. Moreover, it should be understood that snap-locking mechanisms or other forms of locks could be used in order to secure the bar-bell type weights on the bar 38.

Located at the second or outer end of the lever arm 20 is an adjustable positioning mechanism 40. In this embodiment of the invention, the adjustable positioning mechanism 40 comprises a tubular sleeve, and preferably rectangularly shaped tubular sleeve 42, which is welded or otherwise secured to the second transverse end of the lever arm 20 and particularly the lever arm section 24. Vertically shiftably disposed within the tube 42 is a pole 44, the latter of which also has essentially the same size and overall shape as the sleeve 42 but nevertheless which is sized to be shiftably disposed therein. In addition, the tube 42 as well as the pole 44 are provided with a plurality of vertically spaced apart and generally alignable apertures such as apertures 46 as illustrated in FIG. 1 of the drawings. In this way, any one of the apertures 46 may be alignable with an aperture in the tube 42 in order to receive a locking pin 50. Thus, the pole 44 is vertically adjustably positionable with respect to the sleeve 42 and retained in certain positions with respect to the sleeve 42 by means of the locking pin 50.

Shiftably mounted on the vertically shiftable pole 44 of the adjustable positioning mechanism 40 is a sleeve 52 which may be releasably secured to the vertically positionable pole 44 by means of a pin 54. Here again the pin 54 fits in apertures in the sleeve 52 and any one of the set of apertures 46 in the pole 44. In this way, a second means of adjustment is provided for a handle as hereinafter described.

A handle member 56 is secured to the bracket 52 and is thereby capable of being shifted vertically with respect to the lever arm 20. In this case, the handle member 56 includes a U-shaped section 58 which extends outwardly with respect to the lever arm 20.

At its outer end, the handle member 56 is provided with a pair of outwardly diverging handle gripping elements 60. In the manner as illustrated, these handle gripping elements 60 may be provided with hard rubber-type hand grips or similar hand grips as may be required.

In accordance with the above outlined construction, the exercising apparatus of the present invention can be mounted to essentially any existing wall which preferably contains at least some vertically disposed structural member for receiving at least the bracket 10. Thereafter, the exercising apparatus A of the present invention can be shiftable on this bracket 10 so that the user thereof can introduce the required amount of weight on the weight retaining means as for example, the cross bar 38. The user will thereupon engage the handle means 56 and attempt to lift the same against the vertical downward vector force imposed by the weights on the cross bar 38. The lower most limit of movement is controlled by the leg member 26.

This adjustable positioning mechanism is effective in that it enables the handle to be positioned at a desired height to accommodate the overall height of the user. Further, it permits a large number of exercises to be performed with the apparatus of the invention which would not be permitted without adjustable positioning of the handle. For example, some exercisers start with the handle positioned close to the floor and others start with the handle spaced at some distance from the floor.

By reference to FIGS. 1 and 3, it can be observed that the lever arm does not necessarily assume a perpendicular relationship with respect to a vertically disposed wall when in the lower-most position. In fact, it is desirable to have the lever arm assume at least an acute angle with respect to a true horizontal when in the lowermost position. In this way, the user of the apparatus can lie in the prone position and engage the handles and thereby attempt to lift the lever arm against the selected amount of weights disposed thereon.

For the purposes of the invention, it has been found that the lever arm should assume about a 15° angle with respect to a horizontal as aforesaid, although it could exceed this amount but should not assume any more than about a 25°–30° angle with respect to a true horizontal. This arrangement is desirable to enable the handles of the lever arm to be at least 20 inches spaced above the floor or other supporting surface. Moreover, with this distance it is presumed that the lever arm is pivotally secured to the wall or other vertically exposed wall at approximately a three foot height.

In view of the fact that the lever arm can assume an angular position with respect to a true horizontal, the leg mechanism 26 is located in an angular position with respect to the lever arm section 24 and is not truely perpendicular thereto. This arrangement is provided to enable the cross-bar 33 to engage the floor or other horizontal surface in a relatively flat condition when the lever arm 20 is shifted to its lowermost position.

It can be observed that the components of the present invention can be easily fabricated from existing tubular shapes so that the overall exercising apparatus can be constructed at a relatively low unit cost. Moreover, each of the components are designed so that they are easily assembled by means of pivot pins, bolts, or the like. In addition, and by virtue of this construction, it is possible to easily adapt the body exercising apparatus to a wide variety of users. For example, by positioning the various components in proper locations, the apparatus can be used by relatively small or relatively large individuals. Moreover, and by virtue of the construction, it can be arranged in a variety of configurations to permit a wide variety of exercising positions.

Each of the components of the apparatus are preferably formed of a structural metal, such as structural steel. However, it should be understood that the components of the invention could be formed of other materials as for example, plastics and preferably reinforced plastics such as a fiberglass-epoxy resins and the like.

As also illustrated in FIG. 4, the body exercising apparatus of the present invention may also be pivotally secured to a generally stationary structure 70 which is not necessarily secured to a vertically disposed wall and which still operates in accordance with and embodies the present invention.

The stationary structure as illustrated in FIG. 4 is either disposed upon or otherwise secured to a horizontal surface such as a floor. In this case, the structure which pivotally retains lever arm 20 can adopt essentially any size or shape. This latter embodiment of the invention could effectively be used in commercial establishments where a plurality of individual body exercising apparatus are connected to this structure. For example, the structure is illustrated as being rectangular in horizontal cross-section and hence at least four individual body exercising apparatus A of the present invention could be pivotally secured thereto.

FIG. 5 illustrates a modified form of weight lifting body exercising apparatus B which also uses a lever arm 20 pivotally mounted to a U-shaped bracket 72 forming part of a mounting frame 74. In this case, the lever arm 20 is similar to the previously described lever arm 20.

The apparatus B generally comprises a base frame section 76 comprised of a pair of transversely extending base members 78 and an interconnecting longitudinally extending base member 80. A post 82 extends upwardly from the longitudinally extending base member 80 and which carries the bracket 72 near the upper end. At the upper end of the post 82, a somewhat U-shaped upper frame section 84 is provided. Moreover, the upper frame section 84 is constructed so that it has a pair of longitudinally spaced apart rearwardly extending arms 86, the latter being adapted to engage a wall or other supporting surface.

In accordance with the above-outlined construction, it can be observed that this form of mounting frame 74 is highly effective in that it is not necessary to actually mount the lever arm to a fixed wall as such. Nevertheless, the mounting frame 74 is deemed to be a fixed structure in accordance with the present invention. Due to the fact that the transverely extending base members 78 are sufficiently long in dimension, they impart a substantial amount of stability to the apparatus when the user thereof attempts to lift the lever arm 20 with weights imposed thereon. Moreover, for added stability, the rearwardly extending plates 86, as well as the base member 78 could be abutted against a wall or other vertically disposed structure.

The lever arm 20 in the apparatus B is similar to the previously described lever arm 20 in the apparatus A, as aforesaid. Moreover, it would be provided with the depending leg mechanism 26 as shown in the apparatus A along with the adjustable positioning mechanism 40 and the handle member 56. In this way, the apparatus B is similar to the apparatus A except that it is capable of being mounted on a frame as opposed to a vertically disposed wall.

FIG. 6 illustrates an embodiment of the invention which utilizes a frame, as for example, the frame 74 in FIG. 5. In this case, foot pads 88 are mounted on the base members 78 and perhaps the longitudinally extending base member 80. The foot pads 88 are designed so as to establish a high friction contact with the floor of the supporting surface. Thus, the pads 88 could be friction type pads or they could be suction cups, or the like.

FIG. 7, illustrates another modified form of a weight lifting body exercising apparatus C which is in many ways similar to the apparatus B. In this case, the weight lifting body exercising apparatus C includes a frame 90 similar to the previously described frame 74. Moreover, the frame 90 also includes a base frame section 92 similar to the previously described base section 76 and an upper frame section 94, similar to the previously described frame section 74. In this case, however, the depending leg mechanism 26 is not provided on the lever arm 20, but is secured to an additional longitudinally extending base member 96, in the manner as illustrated in FIG. 7. Moreover, this adjustable leg mechanism includes a tubular member 98 with a post 100 telescopically fitted therein. The post can be raised and locked into place by means of a pin 102 which is capable of fitting within apertures 104 formed within the post 100 and in aligned apertures formed within the tube 98.

At its upper end, the post 100 is provided with a plate 105 capable of engaging the lever arm 20 as it reaches its lowermost limit of travel.

Also in the embodiment of the invention, as illustrated in FIG. 7, the arms 76 could be provided with vertically disposed plates 106, the latter provided with apertures 108 for purposes of mounting to a wall or similar structure if desired. Thus, the apparatus could be used in a stand alone configuration, or otherwise, if desired, it could be secured to a vertically disposed wall or similar structure. It should also be recognized that the embodiment of the apparatus illustrated in FIGS. 5, 6 and 7 could be provided with a base plate on the transversely extending legs, at least in the region of the user. This base plate would be sized so that the user of the apparatus could stand on same in order to provide a greater degree of stability to the apparatus.

In another one of the aspects of the invention, it should be noted that the various components forming part of the base frame as well as the apparatus A could be formed of tubular members such as square tubes, in the manner as illustrated. In addition, the tubes could be of other cross-sectional shapes common in the trade, such as, for example, circular tubes, and the like.

Thus, there has been illustrated and described a unique and novel body exercising apparatus which provides for the lifting of removable weights on a pivotally mountable lever arm and which, therefore, fulfills all of the objects and advantages sought therefor. It should be understood that many changes, modifications, variations and other uses in applications will become apparent to those skilled in the art after considering this specification and the accompanying drawings. Therefore, any and all such changes, modifications, variations and other uses in applications which become apparent to those skilled in the art after considering this specification and the accompanying drawings are deemed to be covered by the invention which is limited only by the following claims.

Having thus described my invention, what I desire to claim and secure by letters patent is:

1. A body exercising apparatus comprising:

(a) a lever arm in the form of a single pole-like member having first and second opposite ends, (b) a mounting means on the first end of said lever arm for pivotal mounting to a relatively stationary structure so that said pole-like member is the only element connected to and extending outwardly from said mounting means, (c) bar bell weight retaining means on said lever arm for removably retaining bar-bell type weight discs so that weight discs mounted on said weight retaining means are carried by and moveable with said lever arm, said weight retaining means and the weight discs carried thereby being located between the mounting means and the second end of said lever arm, (d) adjustable positioning means secured to the second end of said lever arm and being located outwardly thereof, said adjustable positioning means comprising a tubular member and a pole vertically shiftable in said tubular member, at least one of said pole or tubular members having pairs of vertically spaced apart holes and the other having at least one pair of holes which are alignable with any of the pairs of spaced apart holes so that a pin element may be inserted in the aligned holes to lock said pole in a selected position with respect to said tubular member, and (e) handle means secured to said pole of said adjustable positioning means at the second end of said lever arm for engagement by the hands of a user of said body exercising apparatus, so that a user may attempt to lift the lever arm pivotally with respect to the mounting means against the weight placed on said weight retaining means, said adjustable positioning means being manually adjustable so that the height of said handle means is adjustably positionable relative to said lever arm.

2. The body exercising apparatus of claim 1 further characterized in that a leg member is associated with said lever arm and is engagable with a floor and the lever arm to control the lowermost limit of movement of said lever arm.

3. The body exercising apparatus of claim 2 further characterized in that the overall length of said lever arm is adjustable.

4. The body exercising apparatus of claim 3 further characterized in that said lever arm has one arm section telescoped within another to be adjustable.

5. The body exercising apparatus of claim 2 further characterized in that said leg member is secured to said lever arm and is engagable with the floor or other supporting surface when the lever arm reaches a desired lowermost limit of travel.

6. The body exercising apparatus of claim 1 further characterized in that said relatively stationary structure comprises a frame capable of being disposed on a floor or other supporting surface.

7. The body exercising apparatus of claim 6 further characterized in that said frame comprises a base frame section and an upstanding post and an upper frame section secured to the upper end of said post, said lever arm being pivotally mounted to said upper frame section.

8. The body exercising apparatus of claim 7 further characterized in that said base frame section and said upper frame section and said post and said lever arm being constructed primarily of tubular metal parts.

9. The body exercising apparatus of claim 6 further characterized in that said leg member is secured to said base frame and is engagable with the lever arm when the lever arm reaches a desired lowermost limit of travel.

10. A wall mountable body exercising apparatus comprising:

(a) a lever arm in the form of a single pole-like member having first and second opposite ends, (b) mounting means on a first end of said lever arm for pivotally mounting only said lever arm of said apparatus to a permanent relatively vertically positioned wall so that said pole-like member is the only element connected to and extending outwardly from said connecting means, said mounting means comprising (1) a bracket having at least one flat plate on said bracket for engagement against a wall, (2) an outwardly struck element on said flat plate for pivotally retaining said first end of said lever arm, (c) bar bell weight retaining means on said lever arm for removably retaining bar-bell type weight discs so that weight discs mounted on said weight retaining means are carried by and moveable with said lever arm, said weight retaining means and the weight discs carried thereby being located between the mounting means and the second end of said lever arm, (d) a leg member depending from said lever arm and being engagable with a floor to control the lowermost limit of movement of said lever arm, and (e) adjustable positioning means secured to the second end of said lever arm and being located outwardly thereof, said adjustable positioning means comprising (1) a tubular member secured to said second end of said lever arm, (2) a pole located within said tubular member, (3) said pole having a plurality of vertically spaced apart holes which are alignable with holes in said tubular member so that a pin element may be inserted in aligned holes in said pole and tubular member to lock said pole in a selected position with respect to said tubular member, and (f) handle means secured to said pole at the second end of said lever arm for engagement by the hands of a user of said body exercising apparatus, so that a user may attempt to lift the lever arm pivotally with respect to the mounting means against the weight placed on said weight retaining means, said adjustable positioning means being manually actuable so that the height of said handle means is adjustably positionably relative to said lever arm.

11. A wall mounting body exercising apparatus comprising:

(a) a lever arm comprised of a first tubular lever arm section and a second lever arm section telescopically fitted within said first lever arm section, said first lever arm section having a first end and said second lever arm section having a second opposite end, (b) pin means extending between said first and second lever arm sections to lock them together, (c) mounting means on a first end of said lever arm for pivotally mounting only said lever arm of said apparatus to a permanent relatively vertically positioned wall, said mounting means comprising (1) a bracket having at least one flat plate on said bracket for engagement against a vertically positioned wall, (2) an outwardly struck clevised element on said flat plate for pivotally retaining said first end of said lever arm, (d) a transversely extending retaining rod rigidly mounted on said lever arm for removably retaining bar-bell type weights, said rod having a cross-sectional size and shape to accomodate apertures in conventional bar-bell type weights, (e) a leg member depending from said lever arm and being engagable with a floor to control the lowermost limit of movement of said lever arm, (f) adjustable positioning means located at the second end of said lever arm, said adjustable positioning means comprising (1) a tubular member having a central bore and being secured to said second end of said lever arm, (2) a pole located within said tubular member and having an overall size and shape to slidably fit within the bore of said tubular member, (3) said pole having a plurality of vertically spaced apart holes which are alignable with holes in said tubular member so that a pin element may be inserted in aligned holes in said pole and tubular member to lock said pole in a selected position with respect to said tubular member, and (g) a handle secured to said pole at a second end of said lever arm for engagement by the hands of a user of said body exercising apparatus, so that a user may attempt to lift the lever arm pivotally with respect to the mounting means against the weight placed on said weight retaining means, said handle having a pair of spaced apart outwardly extending sections with handle portions thereon, said adjustable positioning means being manually actuable so that the height of said handle means is adjustably positionable relative to said lever arm.

12. A body exercising apparatus comprising:

(a) frame comprised of (1) a lower frame section capable of being disposed on a floor or other supporting surface, (2) an upper frame section, (3) at least one post extending between and securing said upper frame section and said lower frame section, (b) a lever arm extending outwardly from said frame, (c) mounting means on a first end of said lever arm for pivotally mounting said lever arm of said apparatus to said frame, (d) a transversely extending retaining rod rigidly mounted on said lever arm for removably retaining bar-bell type weights, said rod having a cross-sectional size and shape to accomodate apertures in conventional bar-bell type weights, (e) a leg member depending from said lever arm and being engagable with a floor to control the lowermost limit of movement of said lever arm, and (f) adjustable positioning means located at the second end of said lever arm, said adjustable positioning means comprising (1) a tubular member having a central bore and being secured to said second end of said lever arm, (2) a pole located with respect to said tubular member and having an overall size and shape to slidably fit within the bore of said tubular member, (3) said tubular member and said pole each having holes which are alignable so that a pin element may be inserted in aligned holes in said pole and tubular member to lock said pole in a selected position with respect to said tubular member, and (g) a handle secured to one of said pole or tubular member at the second end of said lever arm for engagement by the hands of a user of said body exercising apparatus, so that a user may attempt to lift the lever arm pivotally with respect to the mounting means against the weight placed on said weight retaining means, said handle having a pair of spaced apart outwardly extending sections with handle portions thereon, said adjustable positioning means being manually actuable so that the height of said handle means is adjustably positionable relative to said lever arm.

13. A wall mountable body exercising apparatus comprising:

(a) a lever arm in the form of a single pole-like member having first and second opposite ends, (b) mounting means on a first end of said lever arm for pivotally mounting only said lever arm of said apparatus to a permanent relatively vertically positioned wall, said lever arm being the only member extending outwardly from said wall and mounting means, (c) bar bell weight retaining means on said lever arm for removably retaining bar-bell type weight discs so that weight discs mounted on said weight retaining means are carried by and moveable with said lever arm, said weight retaining means and the weight discs carried thereby being located between the mounting means and the second end of said lever arm, (d) a leg member depending from said lever arm and being engagable with a floor to control the lowermost limit of movement of said lever arm, said leg member being located between said wall and said weight retaining means, (e) adjustable positioning means secured to the second end of said lever arm, said adjustable positioning means comprising a tubular member and a pole vertically shiftable in said tbular member, at least one of said pole or tubular member having pairs of vertically spaced apart holes and the other having at least one pair of holes which are alignable with any of the pairs of spaced apart holes so that a pin element may be inserted in the aligned holes to lock said pole in a selected position with respect to said tubular member, and (f) handle means secured to the adjustable positioning means at the second end of said lever arm and being located outwardly thereof for engagement by the hands of a user of said body exercising apparatus so that a user may attempt to lift the lever arm pivotally with respect to the mounting means against the weight placed on said weight retaining means, said adjustable positioning means being manually adjustable so that the height of the handle means is adjustably positionable relative to said lever arm.

14. The body exercising apparatus of claim 13 further characterized in that said mounting means comprises a bracket having at least one flat plate for engagement against a wall and an outwardly struck element for pivotally retaining said first end of said lever arm.

15. The body exercising apparatus of claim 13 further characterized in that said mounting means comprises a bracket having at least one flat plate for engagement against a wall and an outwardly struck element for pivotally retaining said first end of said lever arm. CM

15. A body exercising apparatus comprising:

(a) a lever arm in the form of a single pole-like member having first and second opposite ends, (b) mounting means on a first end of said lever arm for pivotally mounting only said lever arm of said apparatus to a permanent relatively vertically positioned post so that said pole-like member is the only element connected to and extending outwardly from said mounting means, (c) a base frame having at least one first base member and at least one second base member perpendicular to the first base member and which second base member functions as said vertically positioned post, (d) bar bell weight retaining means on said lever arm for removably retaining bar-bell type weight discs so that weight discs mounted on said weight retaining means are carried by and moveable with said lever arm, said weight retaining means and the weight discs carried thereby being located between the mounting means and the second end of said lever arm, (e) a leg member depending from said lever arm and being engagable with a floor to control the lowermost limit of movement of said lever arm, and (f) adjustably positionable handle means at secured to the second end of said lever arm and being located outwardly thereof, said handle means being adapted for engagement by the hands of a user of said body exercising apparatus so that a user may attempt to lift the lever arm pivotally with respect to the mounting means against the weight placed on said weight retaining means, said adjustable positionable handle means comprising a tubular member and a pole vertically shiftable in said tubular member, at least one of said pole or tubular member having pairs of vertically spaced apart holes and the other having at least one pair of holes which are alignable with any of the pairs of spaced apart holes so that a pin element may be inserted in the aligned holes to lock said pole in a selected position with respect to said tubular member, and a handle secured to said pole so that the height of the handle is adjustably positionable relative to said lever arm.

* * * * *